US008037938B2

(12) United States Patent
Jardim De Azevedo et al.

(10) Patent No.: US 8,037,938 B2
(45) Date of Patent: Oct. 18, 2011

(54) SELECTIVE COMPLETION SYSTEM FOR DOWNHOLE CONTROL AND DATA ACQUISITION

(75) Inventors: Meroveu Jardim De Azevedo, Macae (BR); Flavio Froes Sant'ana, Rio Das Ostras (BR); Sebastian C. Calo, Villa Regina (AR); Alejandro Stepkowski, Barra Da Tijuca (BR)

(73) Assignee: Smith International, Inc., Houston, TX (US)

( * ) Notice: Subject to any disclaimer, the term of this patent is extended or adjusted under 35 U.S.C. 154(b) by 184 days.

(21) Appl. No.: 12/474,172

(22) Filed: May 28, 2009

(65) Prior Publication Data

US 2010/0155077 A1 Jun. 24, 2010

Related U.S. Application Data

(60) Provisional application No. 61/138,868, filed on Dec. 18, 2008.

(51) Int. Cl.
*E21B 43/00* (2006.01)

(52) U.S. Cl. ..... 166/313; 166/369; 166/242.6

(58) Field of Classification Search ..... 166/313, 166/369, 381, 387, 242.6
See application file for complete search history.

(56) References Cited

U.S. PATENT DOCUMENTS 6,983,795 B2 * 1/2006 Zuklic et al. ..... 166/51
7,428,932 B1 * 9/2008 Wintill et al. ..... 166/381
7,543,647 B2 * 6/2009 Walker ..... 166/313

OTHER PUBLICATIONS

Schlumberger "TRFC-HN AP and TRFC-HN LP hydraulic flow control valves"; SMP-5761-5; Oct. 2002 (2 pages).
MEA Winners "Unique intelligent comopletion saves $2.8 million" Completions, Individual: One-Trip Natural Gas Lift Solution; Schlumberger; E&P; Apr. 2005 (1 page).

(Continued)

*Primary Examiner* — William P Neuder
(74) *Attorney, Agent, or Firm* — Rodney V. Warfford; Tim Curington

(57) ABSTRACT

A completion system including a packer disposed in a wellbore and a tubular string having a bore therethrough configured to land into the packer. The tubular string includes an alignment sub, a seal assembly disposed below the alignment sub and having at least two longitudinal bores disposed through the seal assembly and offset from the bore of the tubular string. The tubular string also includes a sleeve sub disposed below the seal assembly, wherein the sleeve sub allows fluid communication between a bore of the tubular string and an annulus formed between the tubular string and the wellbore. The tubular string also includes at least two control lines operatively connected to the sleeve sub, wherein the at least two control lines are run through he at least two longitudinal bores of the seal assembly.

20 Claims, 6 Drawing Sheets

OTHER PUBLICATIONS

Weatherford "ROSS Remotely Operated Sliding Sleeve" Hydraulic Flow Control; Weatherford International Ltd. Houston,Texas; 2006-2008 (2 pages).

Weatherford "Pressure Relief Valve" Hydraulic Flow Control; Weatherford International Ltd. Houston, Texas; 2006 (3 pages).

Weatherford "Tubing-Mounted Splice Sub" Intelligent Completions; Weatherford International Ltd. Houston, Texas; 2007 (2 pages).

Ziebel Update "Successful deployments of ZipLog semi-stiff carbon logging "rod" into wellbores acquiring good quality data"; http://www.ziebel.biz/newsletters/ZiebelUpdate2008September.pdf; Sep. 2008 (3 pages). Red Spider Technology "eREd saved at least 6 hours rig time by reducing wireline runs . . . " BP ETAP 22/24a-PWRI-3-eRED Tubing Hanger Plugging Operation; Case Study 01; 005668-00 r2; Feb. 2008 (2 pages).

Red Spider Technology "ZODIAC Optimus Packer" Product Outline Document—ZODIAC Optimus Packer; 003702-00 r0; 2007 (2 pages).

Red Spider Technology "ZODIAC Simplus PVA" Product Outline Document—ZODIAC Simplus PVA; 003997-00 r0; 2007 (3 pages).

Red Spider Technology "Hydraulic Disconnect System" Product Outline Document—Hydraulic Disconnect System; 003346-00 r0; 2007 (3 pages).

* cited by examiner

SELECTIVE COMPLETION SYSTEM FOR DOWNHOLE CONTROL AND DATA ACQUISITION

BACKGROUND OF INVENTION

1. Field of the Invention

Embodiments disclosed here generally relate to a selective completion system for dry or wet tree well. In another aspect, embodiments disclosed herein relate to a method of producing oil from a dry tree well. Embodiments disclosed herein also related to a completion system for oil produced wells or water injection wells.

2. Background Art

The control of oil and gas production wells constitutes an on-going concern of the petroleum industry due, in part, to the enormous monetary expense involved, in addition to the risks associated with environmental and safety issues. Production well control has become particularly important and more complex due to the various environments and formations in which drilling is performed. There is a need for controlling zone production, isolating specific zones and otherwise monitoring each zone in a particular well. Flow control devices such as sliding sleeve valves, downhole safety valves, and downhole chokes are commonly used to control flow between the production tubing and the casing annulus. Such devices are used for zonal isolation, selective production, flow shut-off, commingling production, and transient testing.

In wells with multiple completion zones, valves are also used to isolate the different zones. Typically, during completion of multiple zone wells, a first zone is perforated using a perforating string to achieve communication between the wellbore and adjacent formation after which the zone may be completed (i.e., allow hydrocarbons to flow into the wellbore). If completion of a second zone is desired, a valve and packer may be used to isolate the first zone while the second zone completion operation proceeds. Additional valves may be positioned in the wellbore to selectively isolate one or more of the multiple zones.

In a selective zone completion where flow from each zone is provided and controlled individually, the individual zones are separated by flow tubes. These flow tubes may have to be passed through the valves in an upstream zone to access a downstream zone. To do so, the valves are opened; for example, if flapper valves are used, they are broken by applied pressure or some mechanical mechanism so that the equipment may pass through the upstream zone to the downstream zone. Once the flapper valve is broken; however, the upstream zone is unprotected and the well may start taking fluid until the equipment has been run to and set in the downstream zone. Because zones may be large distances apart (e.g., thousands of feet), the time for the equipment to traverse the distance between the zones may be long, especially if relatively sophisticated equipment such as those in intelligent completion systems are used.

During this time, fluid pressure from the first zone is monitored to detect sudden fluctuations in well pressure which may cause a blowout condition. If well control is required, such as by activation of a blowout preventer (BOP), closing the BOP on tubing which may have cables, flat packs, and hydraulic lines attached to the outer surface of the tubing may damage the attached components and the BOP may not seal properly.

To provide better fluid loss and well isolation control, a formation isolation dual valve (FIDV) may be used. In one example FIDV, a ball valve is used to isolate one zone and a sleeve valve is used to isolate another zone. In conjunction with an isolation packer, the FIDV provides protection for multiple zones while the upper portion of the completion string is being installed.

In a multi-zone wellbore, once an FIDV and associated components are installed, a flow control device may be run into the wellbore and installed above the FIDV to perform flow control of the two or more zones during production. However, installing a separate isolation device (e.g., FIDV) for fluid loss control and flow control device adds to the complexity of completion operations. Effectively, two sets of valves are used for each zone, one for isolation and the other for flow control. Installing the extra components adds to the time and costs of completing a well. In addition, the presence of extra components increases the likelihood that failure of some downhole component may occur, which would then require a work-over operation that typically includes pulling out the completion string, replacing the failed component, and re-installing the completion string. Such work-over operations are extremely expensive and time-consuming.

Various mechanisms may be used to control activation of downhole valves. Such mechanisms may be electrically-activated, pressure-activated, or mechanically-activated. Pressure activation may be accomplished by communicating pressure through production tubing or through one or more control lines running along side the tubing. However, once production of fluids starts, communication of a desired pressure through the tubing may not be possible. Control lines may be used instead. Conventionally, separate hydraulic control lines have been used for different flow control devices. The existence of multiple control lines downhole may make installation of a completion string more difficult and the risk of damage to the control lines may increase, which increases the costs associated with the operation of a well.

The completion systems described above are typically run in subsea systems where the life expectancy of the wells is approximately 15-20 years. The components used in these completion systems are typically very robust, and therefore expensive, such that the components can withstand the high temperatures and pressures associated with deepwater systems for a long life.

A need thus exists for a completion system that is reliable and economically efficient for producing oil from land wells with marginal production.

SUMMARY OF INVENTION

In one aspect, the embodiments disclosed herein relate to a completion system including a packer disposed in a wellbore and a tubular string having a bore therethrough configured to land into the packer. The tubular string includes an alignment sub, a seal assembly disposed below the alignment sub and having at least two longitudinal bores disposed through the seal assembly and offset from the bore of the tubular string. The tubular string also includes a sleeve sub disposed below the seal assembly, wherein the sleeve sub allows fluid communication between a bore of the tubular string and an annulus formed between the tubular string and the wellbore. The tubular string also includes at least two control lines operatively connected to the sleeve sub, wherein the at least two control lines are run through he at least two longitudinal bores of the seal assembly.

In another aspect, the embodiments disclosed herein relate to a method of producing a well including setting at least on packer in the well and perforating the well below the at least one packer. The method also includes running a tubular string into the well, the tubular string including an alignment sub and a seal assembly disposed below the alignment sub and having at least two longitudinal bores disposed through the seal assembly and offset from the bore of the tubular string. The tubular string also includes a sliding sleeve sub disposed below the seal assembly, wherein the sliding sleeve sub allows fluid communication between the bore of the tubular string and an annulus formed between the tubular string and the wellbore. The tubular string also includes at least two control lines operatively connected to the sliding sleeve sub, wherein the at least two control lines are run through the at least two longitudinal bores of the seal assembly. The method further including engaging the seal assembly with the at least on packer, operating the sliding sleeve sub to move the sleeve into an open position, and flowing a formation fluid from an annulus between the tubular string and a wall of the well into the tubular string.

In another aspect, the embodiments disclosed herein relate to a method to inject fluid into a wellbore, the method including setting at least one packer in a wellbore and running a tubular string into the wellbore. The tubular includes an alignment sub and a seal assembly disposed below the alignment sub and including at least two longitudinal bore disposed through the seal assembly and offset from the bore of the tubular string. The tubular string also includes a sliding sleeve sub disposed below the seal assembly, wherein the sliding sleeve sub allows fluid communication between the bore of the tubular string and an annulus formed between the tubular string and the wellbore. The tubular string also includes at least two control lines operatively connected to the sliding sleeve sub, wherein the at least two control lines are run through the at least two longitudinal bores of the seal assembly. The method further including engaging the seal assembly with the at least one packer and injecting a fluid from the tubular string into the wellbore.

Other aspects and advantages of the invention will be apparent from the following description and the appended claims.

DETAILED DESCRIPTION

Embodiments disclosed herein relate to a selective completion system for dry or wet tree wells. More specifically, embodiments disclosed herein relate to Embodiments disclosed herein also related to a completion system for oil produced wells or water injection wells. Embodiments disclosed herein also relate to a selective completion system for water injection in a wellbore to increase oil production and a method for injecting the water in a well.

Embodiments disclosed herein relate to a completion system used in completing dry tree wells (i.e., well's where the wellhead is above water). In particular, embodiments disclosed herein provide a simple and cost effective completion system used in the production of land wells with marginal production. Land wells with marginal production are usually characterized by low pressures and low temperatures. Additionally, due to the marginal production, the life expectancy of these wells is typically three years or less. Further, in certain embodiments, the completion system in accordance with the present disclosure is an intelligent completion system. In other words, a completion system in accordance with the present disclosure may include downhole gauges (e.g., pressure and temperature gauges, for monitoring downhole conditions and production). Optical and/or electrical lines may be run downhole for sending and or receiving information between the downhole gauges and the surface.

Figure 1:
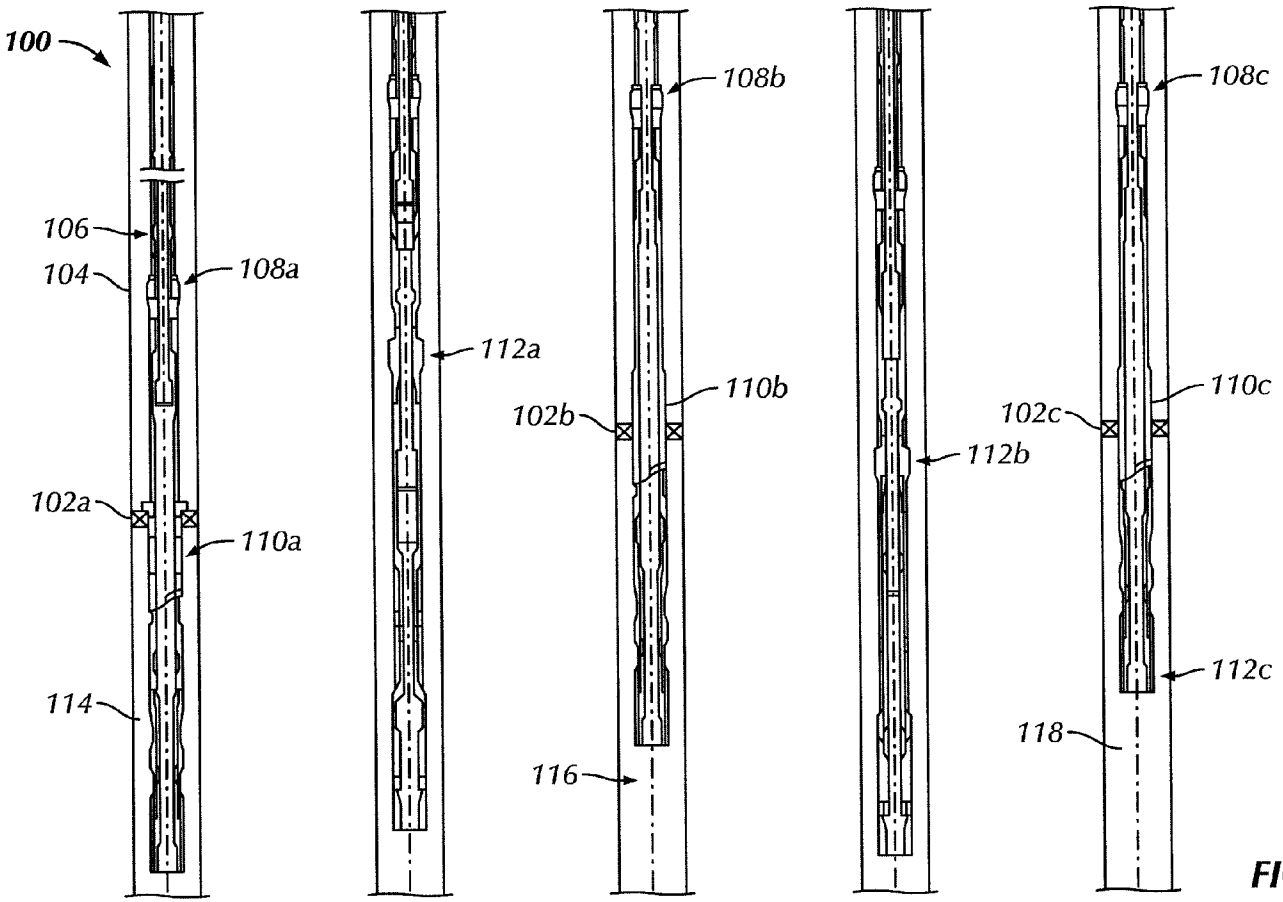
FIG. 1 is a schematic illustration of a completion system according to embodiments of the present disclosure.

Referring initially to FIG. 1, a completion system 100 in accordance with embodiments disclosed herein is shown. While shown in segments in the illustration, one of ordinary skill in the art will appreciate that completion system 100 is one continuous tool. The completion system 100 provides for isolation of and production from three zones. The completion system 100 includes at least one packer 102*a*, 102*b*, and/or 102*c* disposed in a cased well 104 and a tubular string 106 configured to be run through the at least one packer. The packer may be a permanent or semi-permanent packer. The packer may be run in the well on electric wireline, production tubing, or by other methods known in the art and disposed at desired depths in the well (i.e., above or below perforations in the well).

The tubular string 106 includes a first alignment sub 108*a*, a first seal assembly 110*a* disposed below the first alignment sub 108*a*, and a first hydraulically actuated sliding sleeve sub 112*a* disposed below the first seal assembly 110*a*. For completions systems used in a well having three zones of production 114, 116, 118, as shown in FIG. 1, the tubular string 106 may further include a second packer 102*b*, a third packer 102*c*, a second alignment sub 108*b*, a third alignment sub 108*c*, a second seal assembly 110*b*, a third seal assembly 110*c*, and a second sliding sleeve 112*b* . Further, a plurality of control lines (not independently illustrated) is assembled to the tubing string 106. The plurality of control lines may include hydraulic lines for actuating a hydraulically actuated sleeve of the hydraulically actuated sleeve sub 112 and optical and/or electrical lines for transmitting information between downhole gauges and the surface.

From an operational perspective, completion system 100 used for isolating three production zones may thus include an upmost packer 102*a* disposed longitudinally proximate the surface and above a first production zone 114. Completion system 100 thus includes a tubing string 106 having a first alignment sub 108*a* in fluid communication with a first seal assembly 110*a*. First seal assembly 110*a* is disposed engaged with packer 102*a*, thereby sealing the wellbore above the first production zone. 114. To allow the flow of fluids through tubular string 104, first sliding sleeve 108*a* is fluidly connected to first seal assembly 110*a*. Upon actuation, first sliding sleeve 108*a* may be opened, thereby providing a flow path from the wellbore into tubing string 106 and to the surface.

In order to keep first production zone 114 isolated from second production zone 116, a second packer 102*b* may be disposed downhole. In order to access second production zone 116, second alignment sub 108*b* may be fluidly connected to first sliding sleeve 110*a*. Second alignment sub 108*b* is then connected to second seal assembly 110*b*, which is engaged with second packer 102*b*, thereby sealing first production zone 114 from second production zone 116. Longitudinally disposed below and fluidly connected to second alignment sub second seal assembly 110*b* is second sliding sleeve 112*b*. Second sliding sleeve 112*c* may thus be actuatable to allow fluid from second production zone 116 to flow into tubular string 106 and back to the surface.

In order to isolate the second production zone 116 from the third production zone 118, a third packer 102*c* may be disposed in the wellbore. To access third production zone 118, a third alignment sub 108*c* may be fluidly connected to second sliding sleeve 112*c*. Third alignment sub 108*c* is therein fluidly connected to third seal assembly 110*c*, which is disposed engaged with third packer 102*c*. Below third seal assembly 110*c*, third sliding sleeve 112*c* is disposed. Third sliding sleeve 112*c*, similar to first and second sliding sleeve 112*a*, 112*b* is configured to allow a flow of hydrocarbons to flow into tubing string 106 from third production zone 118. Those of ordinary skill in the art will appreciate that control lines (not shown) may run the entire length of the tubing string 106 along alignment subs 108, seal assemblies 110, and sliding sleeves 112.

Although the completion system 100 of FIG. 1 provides isolation and production from three zones, a similar configuration of components may be used for producing a single zone, two zones, or more than three zones. Specifically, the number of packers 102, alignment subs 108, hydraulically actuated sliding sleeve subs 112, and sealing assemblies 110 may be varied based on the number of zones to be produced. A description of the individual components is now disclosed.

As described above, the packers 102*a*, 102*b*, and/or 102*c* may be permanent or semi-permanent packers that are set in the well at predetermined locations based on the perforations of the well. The packers 102 seal an annulus formed between the tubing string 106 and wellbore casing/lining 104. In alternate embodiments, the packers 102 may seal an annulus between the outside of the tubular string 106 and an unlined borehole.

Figure 2A:
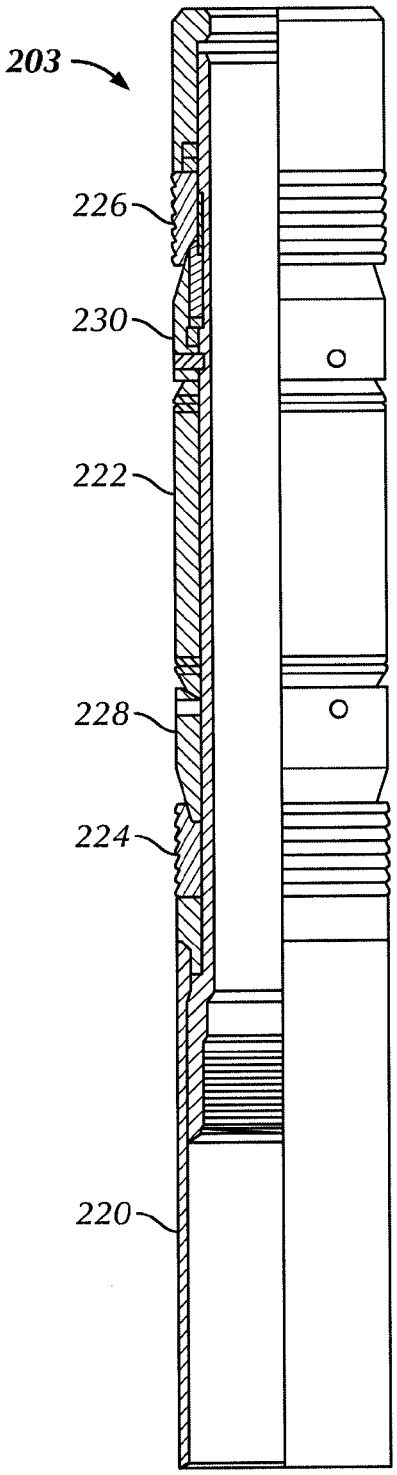
FIG. 2A is a partial cross-section of a packer according to embodiments of the present disclosure.

Referring to FIG. 2A, an examplary permanent packer 203 in accordance with embodiments disclosed herein is shown. As shown, permanent packer 203 includes a mandrel 220 having a sealing element 222 disposed therearound. A first cone 228 and a first slip 224 are disposed above the sealing element 222 and a second cone 230 and a second slip 226 are disposed below the sealing element 222. Generally, the permanent packer 203 may be set by applying a pressure or load to the packer 203 to move slip 224, 226 in an axial direction toward the other slip 226, 224. As slips 224, 226 move axially toward each other, the sealing element 222 is compressed and radially extended into contact with the casing (not shown). Further, as slips 224, 226 move axially toward one another, the slips also move radially outward into contact with the casing (not shown) due to the sloped surface of the cones 228, 230. Engagement of the slips with the casing secures the packer 203 in place in the casing and maintains sealing element 222 in contact with the casing. Permanent packer 203 is described as one example of a permanent packer. One of ordinary skill in the art will appreciate that other packers, permanent, semi-permanent, or retrievable, may be used without departing from the scope of embodiments disclosed herein.

In addition to permanent packers, semi-permanent packers may also be used. Both permanent and semi-permanent packers may be used to provide unrestricted flow and passage of full gauge wireline tools and accessories through a wellbore, such that production zones may be isolated, injection operations may be performed, and hydrocarbons may be produced. In the use of a semi-permanent packer, the packer may be retrieved, when production decreases below acceptable levels, by releasing the packer (e.g., by turning the body of the packer) and then pulling the packer back uphole. Furthermore, in certain embodiments, setting permanent and semi-permanent packers includes setting packers with production tubing in tension, compression, or neutral, thereby allowing the packers to be used in both deep and shallow wells.

Depending on the requirements of the completion/production operation, the internal diameter of the bore of the packer may vary. Additionally, the packer may be actuated using either hydraulic or mechanical actuation. While the present embodiments illustrate a single sealing element 222, in other embodiments, multiple sealing elements 222 may be used. Those of ordinary skill in the art will appreciate that other design specifics, such as differential pressure rating, may also be varied without departing from the scope of the present disclosure.

Figure 2B:
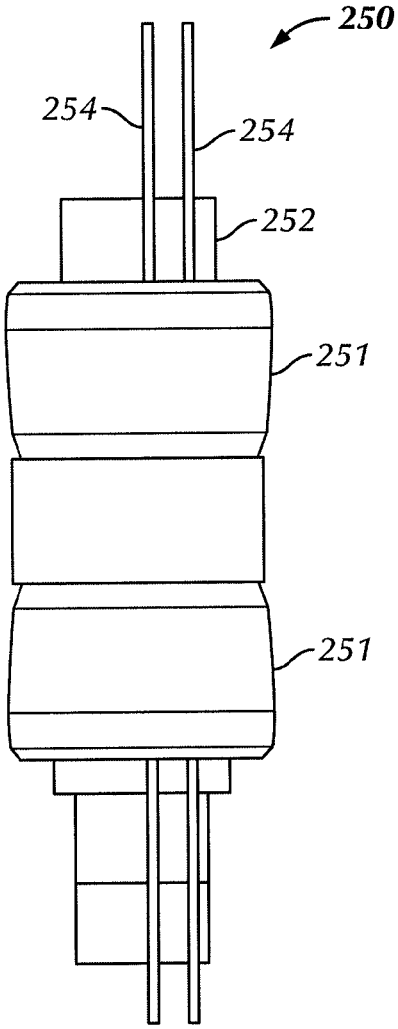
FIG. 2B is a side view of a cup-type packer according to embodiments of the present disclosure.

Referring to FIG. 2B, an alternate packer design according to embodiments of the present disclosure is shown. In this embodiment, a cup-type packer 250 is illustrated having two elastomeric cups 251 disposed around a central bore 252. As cup-type packer 250 is lowered into a wellbore, the cups 251 compress through deformation to fit within the inner diameter of the wellbore. When the cup-type packer 250 reaches the proper location within the wellbore, then cups 251 seal against the wellbore.

Additionally, as pressurized fluid is supplied from above or below, the fluid pressure may further radially expand cups 251, thereby increasing the strength of the seal. Those of ordinary skill in the art will appreciate that cup-type packers 250 may be configured in various ways. For example, cups 251 may be disposed facing upward or downward, and multiple cup arrangements may be used. For example, in certain embodiments, multiple downward facing cups 251 may be used, while in other embodiments, only upward facing cups 251 may be used. In still other embodiments multiple cup-type packers 250 may be used on a single completion/production tool assembly, thereby isolating multiple production zones.

Figure 2C:
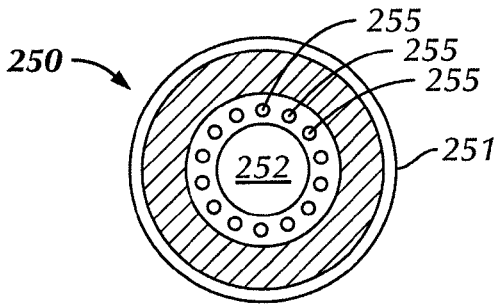
FIG. 2C is a cross-section of a cup-type packer according to embodiments of the present disclosure.

Cup-type packer 250 may also include multiple control lines 254 extending therethrough. Control lines 254 extend axially through cups 251 and around central bore 252. Referring briefly to FIG. 2C, a top view of a cup-type production packer 250 according to embodiments of the present disclosure is shown. FIG. 2C illustrates a cup-type packer 250 having multiple control line bores 255 disposed around central bore 252. Because control lines 254 extend through cup-type packer 250, multiple components located longitudinally below the cup-type packer 250 in the wellbore may be controlled. The number of control lines 254, and thus control line bores 255 that are required for a particular operation, may depend on, for example, the number of downhole tools and the number of production zones. In an aspect wherein there are two production zones, and components of each production zone requires two control lines, cup-type packer 250 may have four control lines 252 and control line bores 255. However, in other embodiments, cup-type packer 250 may have greater or fewer control lines 252 and/or control line bores 255. Unused control line bores 255 may be plugged, thereby preventing the flow of fluid therethrough. In other aspects, only the necessary control line bores 255 that are needed may be formed. Additionally, when installing control lines 252 through control line bores 255, the top and or bottom of control line bores 255 may be sealed, thereby preventing fluid from flowing through the control line bores 255, thereby bypassing cup-type packer 250.

Cup-type packers 250 may be used in completion systems including permanent or semi-permanent packers to seal multiple production zones. In such an embodiment, the outer diameter of the cup-type packer 250 may be configured to fit through an internal diameter of an inner bore of the permanent or semi-permanent packer. In still other embodiments, only cup-type packers 250 may be used, thereby removing the need for permanent or semi-permanent packers. Those of ordinary skill in the art will appreciate that various configurations of completion systems using permanent, semi-permanent, and cup-type packers are within the scope of the present disclosure.

Figure 3:
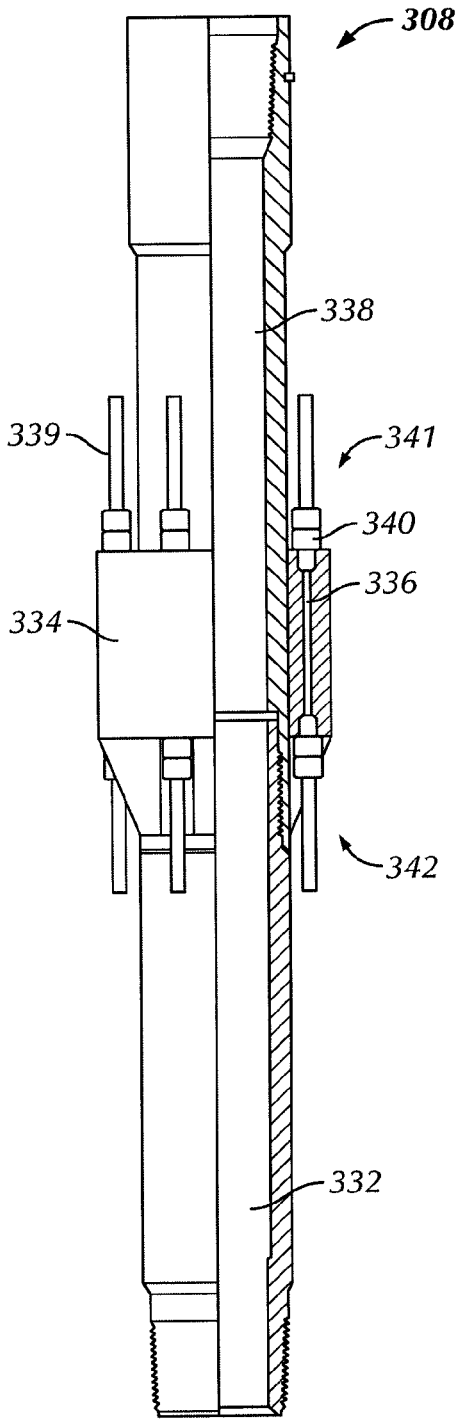
FIG. 3 is a partial cross-section of an alignment sub according to embodiments of the present disclosure.

Referring now to FIG. 3, a partial cross-section of an alignment sub 308 in accordance with embodiments disclosed herein is shown. The alignment sub 308 includes a tubular body 332 and an extension portion 334. Extension portion 334 is a portion of the tubular body 332 that has a diameter greater than the tubular body 332. The extension portion 334 may be integrally formed with the tubular body 332 or may be formed and attached separately. The extension portion 334 includes at least two longitudinal bores 336 disposed therethrough and radially offset from a central bore 338 of the body 332. At least two control lines 339 are disposed through the longitudinal bores 336.

A plug or seal 340 may be circumferentially disposed around the at least two control lines 339 and inserted in a first end 341 and a second end 342 of the longitudinal bores 336 to seal the longitudinal bores 336. One of ordinary skill in the art will appreciate that the plugs 340 may be threadedly engaged with the longitudinal bores 336, pres-fit into the longitudinal bores 336, or inserted by any other method known in the art. Further, as shown, three or more control lines 339 may be disposed through three or more longitudinal bores 336 and circumferentially arranged around body 332 of the alignment sub 308. The number of control lines 339 may depend on the number of production zones in the well, and therefore the number of hydraulically actuated sliding sleeve subs (112 of FIG. 1), and the number of optical or electrical lines needed for various downhole gauges and sensors. The alignment sub 308 provides support and alignment for the control lines 339 running downhole so as to prevent tangling or damage of the lines as the tubing string 106 is run into the well.

Figure 4:
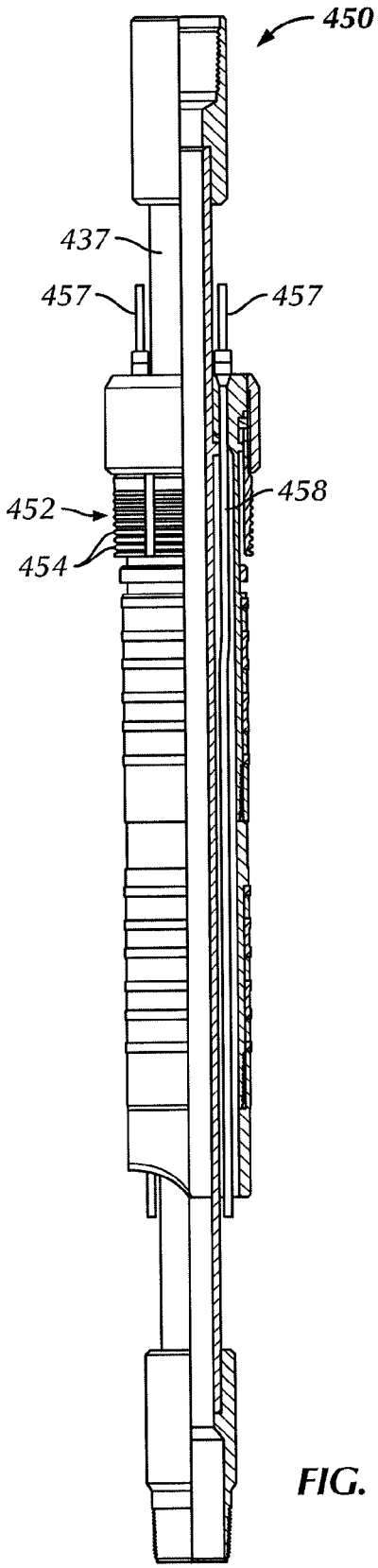
FIG. 4 is a partial cross-section of a seal assembly according to embodiments of the present disclosure.
Figure 5:
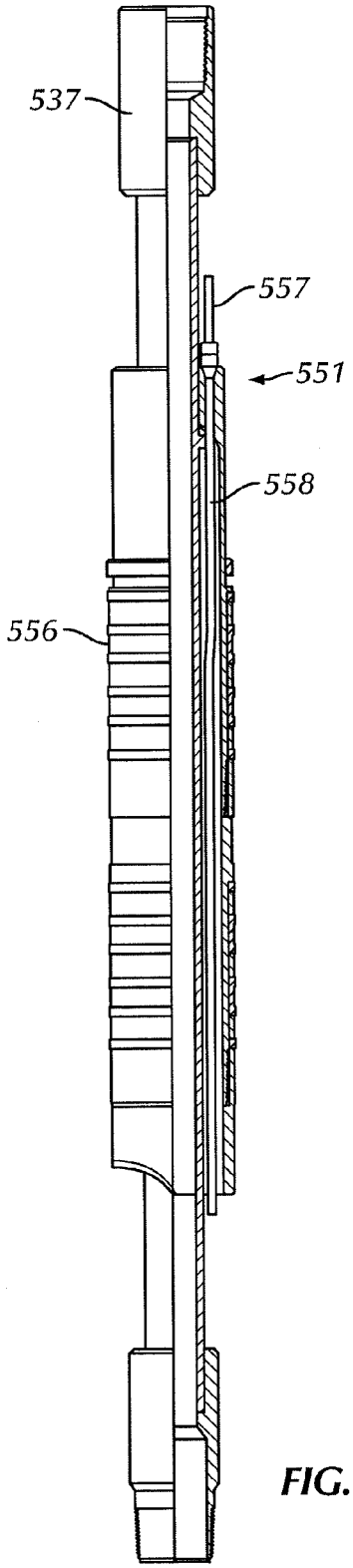
FIG. 5 is a partial cross-section of an alternate seal assembly according to embodiments of the present disclosure.

Referring now to FIGS. 4 and 5, sealing assemblies 450 and 551 in accordance with embodiments disclosed herein are shown. FIG. 4 shows a first sealing assembly 450 that includes an anchor 452 and at least one sealing element 456 and FIG. 5 shows a second sealing assembly 551 that includes at least one sealing element 556, but no anchor. In accordance with embodiments disclosed herein, the first sealing assembly 450 may be used to seal the first or upmost production zone 114 (FIG. 1), while the second sealing assembly 551 may be used to seal the second and third production zones 116, 118 (FIG. 1). In alternate embodiments. The second sealing assembly 551 may be used to seal the first, second, and third production zones 114, 116, 118. In yet another embodiment, the first sealing assembly 450 may be used to seal the first, second, and third production zones 114, 116, 118.

Referring to FIG. 4, the first sealing assembly 450 includes a body 437 and an anchor 452 disposed thereon, the anchor 452 configured to engage an inner surface of the first packer 102*a* (FIG. 1) disposed in the well. In one embodiment, the anchor 452 may include a plurality of grips or teeth 454 to provide mechanical engagement of the anchor 452 with the inner surface of the first packer 102*a* (FIG. 1). The first sealing assembly 450 further includes at least one sealing element 456 disposed below the anchor 452. The sealing element 456 may be formed from any material known in the art, for example, elastomer. The sealing element 456 is configured to seal against the inner surface of at least one packer 102 disposed in the well. In one embodiment, sealing element 456 of the first sealing assembly 450 is configured to seal against the inner surface of the first packer 102*a* (FIG. 1). Sealing engagement between the first sealing assembly 450 and the first packer 102*a* (FIG. 1) provides isolation of the first production zone 114. Because through bores (not shown) of packers have relatively tight tolerances, first sealing assembly 450 may compression fit within the through bore, thereby allowing for the packer and first sealing assembly 450 to isolate production zones. Furthermore, those of ordinary skill in the art will appreciate that when selecting sealing assemblies 450 for a particular operation, the sealing assembly 450 may be sized for a particular packer through bore diameter.

First sealing assemblies 450 having anchors 452 typically lock or anchor into the top of a packer (102 of FIG. 1) and seal in the bore of the packer or seal bore extension below the packer. First sealing assemblies 450 transfer tubing forces through anchor 452 in the packer such that the seals created by sealing element 456 are static and are thus only subjected to pressure differentials. Depending on the requirements of the completion and production operation, the method of setting and releasing first seal assembly 450 may vary. For example, in certain embodiments first sealing assembly 450 is run into a wellbore until the sealing element 456 is axial disposed at an orientation to seal against the packer. An operator may know that the first sealing assembly is properly oriented when the amount of load required to move the production string increases above a normal load requirement. The load increases because anchor 452 has engaged a packer, thereby preventing the first sealing assembly 450 to move axially downward into the wellbore past the packer. In certain embodiments, a spacer tube (not shown) may be used to facilitate positioning sealing element 456 within the packer.

To remove first sealing assembly 450 from the wellbore, engagement with the packer may be severed. To disengage first sealing assembly 450 from the packer, right-hand rotation may be applied to first sealing assembly 450, thereby releasing anchor 452 from the packer. In other embodiments, a snap latch (not shown), also known as a shear release assembly, may be provided. A snap latch releases first sealing assembly 450 from the packer when a specified force is applied thereto. For example, an upward force of 10000 pounds may be applied to first assembly 450, thereby severing retaining pins (not shown) and disengaging anchor 452 from the packer. Those of ordinary skill in the art will appreciate that alternative types of sealing assemblies may be used depending on the specific requirements of the completion/production operation. For example, in certain embodiments, rotation may result in electrical connection failure during the disengaging first sealing assembly 450. In such an embodiment, anchor 452 may be released by tension, in stead of rotation, thereby preventing damage to electrical components of first sealing assembly 450.

First sealing assembly 450 also includes control lines 457 disposed around body 437. Control lines 457, as described above, may include hydraulic, electric, fiber optic, or other types of lines, which may be used to provide fluid or control components of a completion/production assembly. As illustrated, control lines 457 are disposed around body 437 and provide a bore 458 that extends within first sealing assembly 450. By providing bore 458 through first sealing assembly

450, control lines 457 may be isolated from a flow of produced fluid flowing through first sealing assembly 450, while also allowing for control of other downhole components.

Depending on the number of production zones, the number of control lines 457, may vary. For example, in an embodiment of a completion/production tool assembly for use in a three-production zone wellbore, six control lines 457 may be provided. Six control lines 457 may thereby provide at least two control lines 457 for each production zone. By providing multiple control lines 457 for each production zone, different components may be activated or deactivated substantially simultaneously. Additionally, multiple control lines 457 for each production zone may be required to properly activate a particular component, such as a component of the completion/production assembly that requires modulation between an upward and a downward pressure, such as hydraulically actuated sliding sleeve subs (112 of FIG. 1).

Referring now to FIG. 5, the second sealing assembly 551 includes a body 537 and at least one sealing element 556 disposed therearound. The at least one sealing element 556 may be formed from any material known in the art, for example, an elastomer. The at least one sealing element 556 is configured to seal against an inner surface of at least one of the packers (102 of FIG. 1) disposed in the well. Sealing engagement between the second sealing assembly 551 and the packer (102 of FIG. 1) may provide isolation of the second or third production zones (116, 118 of FIG. 1).

When running second sealing assembly 551 into the wellbore, the completion/production tool assembly may include multiple second sealing assemblies 551 for each packer that is disposed in the wellbore. For example, in an embodiment having three packers, and thereby at least three production zones, each packer may be set in the wellbore above the production zone. The completion/production tool assembly having a first sealing assembly (450 of FIG. 4) having an anchor and two second sealing assemblies 551 disposed axially below the first sealing assembly may then be run into the wellbore. A seal between second sealing assemblies 551 and respective packers may thus be created when the first sealing assembly anchors onto a first packer (102*a* of FIG. 1). Because the axial distance between the packers is known, second sealing assemblies 551 may be disposed on the completion/production tool assembly with equivalent spacing. Thus, when the first sealing assembly properly engages the first packer, the second sealing assemblies 551 properly engage second and third packers (102*b*, 102*c* of FIG. 1), respectively. Those of ordinary skill in the art will appreciate that depending on the number of production zones, the number of second sealing assemblies 551 may vary. Thus, less than three, or more than three second sealing assembly 551 may be used to isolate more or less than three production zones.

Second sealing assembly 551 also includes control lines 557 disposed around body 537. Control lines 557, as described above, may include hydraulic, electric, fiber optic, or other types of lines, which may be used to provide fluid or control components of a completion/production assembly. As illustrated, control lines 557 are disposed around body 537 and provide a bore 558 that extends within first sealing assembly 450. By providing bore 458 through first sealing assembly 450, control lines 457 may be isolated from a flow of produced fluid flowing through first sealing assembly 450, while also allowing for control of other downhole components.

Depending on the number of completion/production tool assembly components being run into the wellbore, the number of control lines 557 may vary. For example, in a three-production zone wellbore, the number of control lines 557 for each second sealing assembly 551 may be different. In a three-production zone wellbore, where there are two second sealing assemblies 551, the second sealing assembly 551 located longitudinally closer to the surface may require more control lines 557 than a longitudinally distal second sealing assembly 551. Because the second sealing assembly 551 disposed in the wellbore closer to the surface requires control lines to run to all components below, while the distally second sealing assembly 551 requires control lines 557 for fewer components, the distally disposed second sealing assembly 551 may only have control lines 557 for controlling components disposed therebelow. In other embodiments, each second sealing assembly 551 may include multiple control lines 557, regardless of whether they are being used on distally disposed components of the completion/production tool assembly.

Figure 6A:
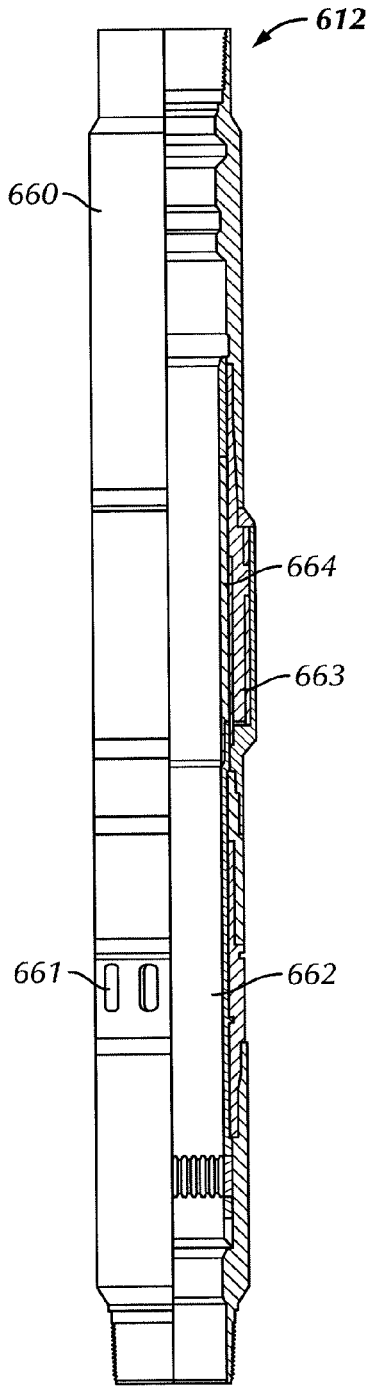
FIG. 6A is a partial cross-section of a sliding sleeve according to embodiments of the present disclosure.

Referring to FIG. 6A, a hydraulically actuated sliding sleeve 612 according to embodiments of the present disclosure is shown. In this embodiment, sliding sleeve 612 includes a body 660 having ports 661 providing fluid communication between the wellbore and an internal bore 662. Ports 661 may be opened or closed by hydraulically actuating a slide 663 disposed within body 660. Thus, sliding sleeve 612 of FIG. 6A has two positions, either an open port position, whereby flow is allowed to enter internal bore 662 or a closed port position, whereby flow is not allowed to enter internal bore 662. To modulate between open and closed port positions, hydraulic flow through control lines 664 may be varied. In one aspect, increasing the hydraulic pressure supplied through control line 664 may move slide 663 either axially upward or downward, thereby opening ports 661. Similarly, by decreasing the hydraulic pressure, slide 663 may be returned to a normal position, whereby ports 661 are closed. Thus, sliding sleeve 612 may be modulated between two positions, thereby allowing for hydrocarbons to be produced or a production zone isolated, depending on the requirements of the completion/production operation.

Figure 6B:
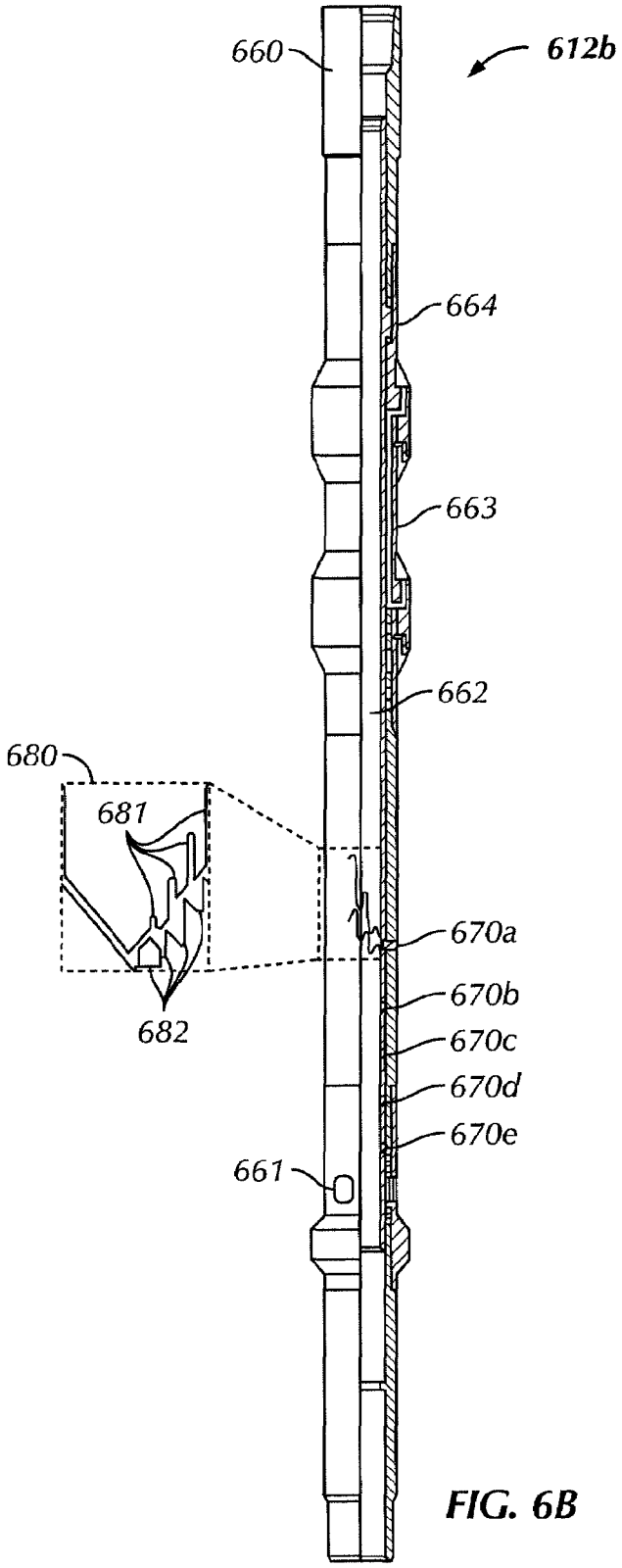
FIG. 6B is a partial cross-section of an alternate sliding sleeve according to embodiments of the present disclosure.

Referring to FIG. 6B, an alternate hydraulically actuated sliding sleeve 612*b* according to embodiments of the present disclosure is shown. In this embodiment, a sliding sleeve 612*b* configured to provide multiple flow rate to port 661 is illustrated. Similar to sliding sleeve 612 of FIG. 6A, sliding sleeve 612*b* has a body 660 and an internal bore 662. Thus, fluid communication may be achieved between the wellbore and internal bore 662 through ports 661. Unlike sliding sleeve 612 of FIG. 6A, sliding sleeve 612*b* may be modulated to provide or receive a flow of fluid at different rates. To modulate the rate at which fluid flows out of or into ports 661, a slide 663 may be moved. By adjusting the location of slide 663 within body 660, the flow rate of fluid from internal bore 662 out of port 661 may be adjusted. In this embodiment, slide 663 move along a track (not shown) disposed between the inner diameter of the body 660 and the outer diameter of the sleeve (not shown). Thus, the track allows for alignment of the openings on the sleeve with openings on the body 660.

To adjust the flow rate, slide 663 may be adjusted in flow rate increments, such as zero flow rate 670*a*, twenty-five percent flow rate 670*b*, half flow rate 670*c*, seventy-five percent flow rate 670*d*, and one-hundred percent flow rate 670*e*. To adjust the flow rate, slide 663 may be moved axially upward and downward, as well as rotated radially within body 660. To move slide 663, an operator may change a hydraulic pressure by modulating the pressure applied through control lines 664 between a pressure applied from above and below slide 663. Pressure schematic 680 provides an illustration of how the flow rate may be adjusted. Pressure schematic 680 illustrates that by modulating a pressure from above 681 or below 682, the position of the slide 663 along the track may be adjusted. Thus, an operator may adjust a flow rate of fluid in or out of ports 661 based on the requirements of the completion/production operation.

Referring to FIGS. 6A and 6B together, sliding sleeve 612, 612*b* may include various types of sliding sleeves 612, 612*b*. While the above description is specific to hydraulically actuated sliding sleeves 612, 612*b*, in other embodiments, sliding sleeve 612 may be actuated using electrically or mechanically. Thus, sleeve 663 may be mechanically or electrically adjusted, thereby establishing fluid communication between internal bores 662 and the wellbore. In specific embodiments, sliding sleeve 612, 612*b* may also include elastomeric or non-elastomeric seals, collet locks, and valves of various profile sizes. Thus, sliding sleeve 612, 612*b* may be opened and closed repeatedly, as the flow rate requires adjustment. Additionally, sliding sleeve 612, 612*b* may include multiple control lines 664 running therethrough, thus allowing fluid communication between multiple components on the completion/production tool assembly. Those of ordinary skill in the art will appreciate that sliding sleeves 612, 612*b* may also be used to perform zone-specific tasks, such as testing and stimulation, and as such, may include additional components not explicitly disclosed herein.

Figures 7A, 7B, 7C, 7D:
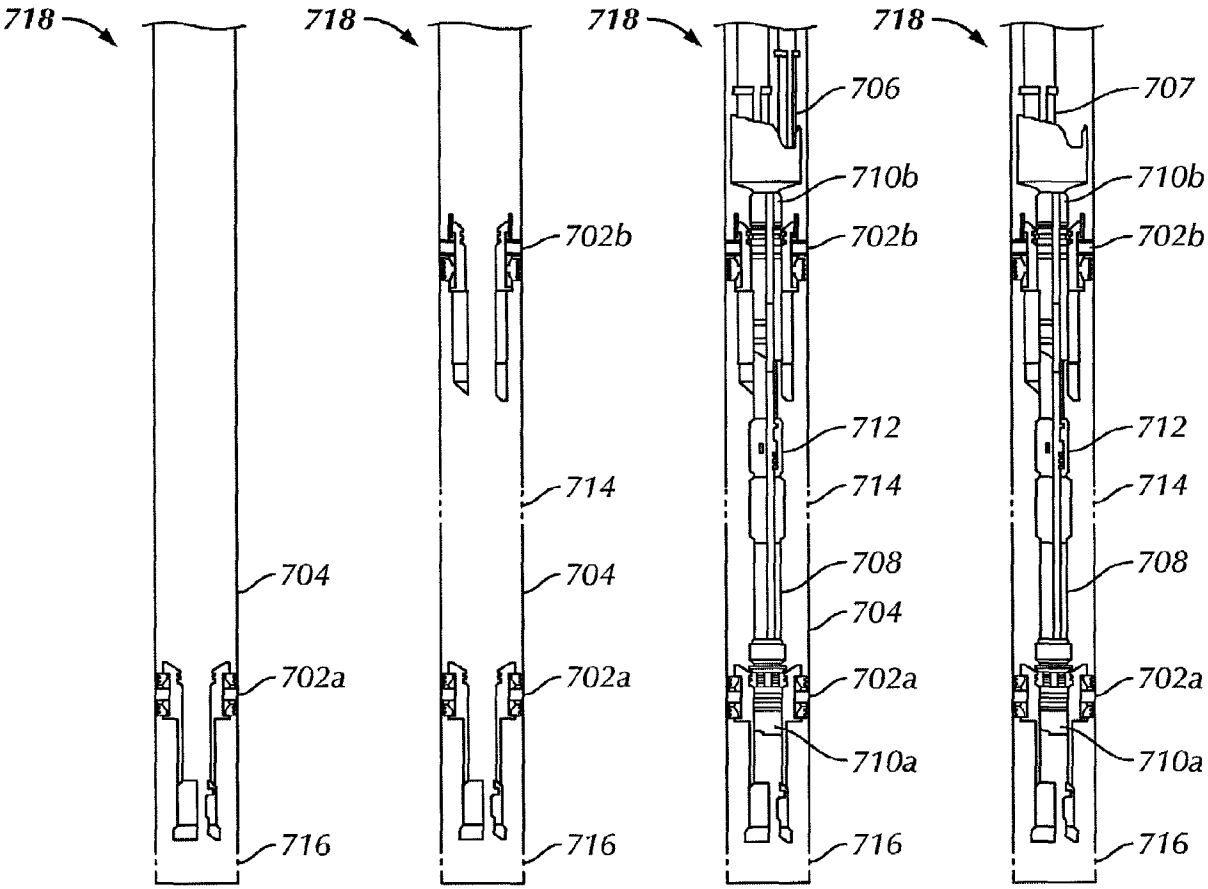
FIG. 7A-7D are schematic representations of installing a completion system in a wellbore according to embodiments of the present disclosure.

Referring to FIGS. 7A-7D, a schematic representation of a completion system being disposed in a wellbore, is shown. In this embodiment, a first packer 702*a* is disposed in a wellbore 704 (FIG. 7A). First packer 702*a* may be a permanent, semi-permanent, or cup-type packer. As illustrated, first packer 702*a* is a permanent style packer. Additionally, first packer 702*a* is the lowest (i.e., most distal) packer in the wellbore. First packer 702*a* thereby may be used to isolate a second production zone 716 from a first production zone 714.

After first packer 702*a* is set in the wellbore 704, a second packer 702*b* may be run into and expanded within the wellbore 704 (FIG. 7B). Thus, the surface 718 is isolatable from first production zone 714 and first production zone 714 is isolatable from second production zone 716. After the first and second production zones 714, 716 are isolatable, a tool assembly having a first and second seal assembly 710*a*, 710*b*, as well as at least a sliding sleeve 712, may be disposed in the wellbore (FIG. 7C). The tool assembly may also have one or more alignment subs 708. Thus, hydrocarbons may be produced from the second production zone 716, through tubing string 706, and hydrocarbons may also be produced from the first production zone 714 through tubing string 706. Above packer 702*b* multiple tubing string 706 flow paths may prevent the commingling of produced fluids. Thus, the fluids produced from the first production zone 716 may have a discrete flow path from the fluids produced from the second production zone 714. In other embodiments, the fluid may commingle (FIG. 7D), and as such, tubing string 707 may be a single tubular. Those of ordinary skill in the art will appreciate that whether produced fluids are allowed to commingle, or whether they remain separated will depend on the requirements and parameters of individual production zones, such as hydrocarbon content, water content, contaminants, etc.

Furthermore, in certain embodiments, the completion system may include additional components, such as additional packers, seal assemblies, sliding sleeves, and/or alignment subs. The components of the completion system may also include control lines running the length of the tubing string 706, 707, thereby allowing multiple components to be controlled, as well as provide data gathering capability from the various production zones. Furthermore, in certain operations, the methods disclosed herein may be used for both completion/production and injection operations. Injection operations may be used to inject, for example, water or another fluid into a wellbore to increase pressure in the formation, thereby increasing the flow rate of hydrocarbons from the well. In such an embodiment, an adjustable sliding sleeve, as discussed above, may be used such that the flow rate of a fluid being injected may be controlled.

Additional steps may also be required when installing the system in a wellbore. For example, prior to producing from the well, the wellbore is perforated. Perforating the wellbore may include using explosive charges to perforate the formation, thereby increasing the flow of formation fluids, including hydrocarbons, therefrom. Those of ordinary skill in the art will appreciate that perforating the wellbore and injecting water into the wellbore may occur at various times during completion/production, as well as during work-over or well conditioning operations. Thus, the system disclosed herein may be used for various operations before and/or during completion and production.

Advantageously, embodiments disclosed herein may provide for systems and methods for producing fluids from depleted reservoirs in an efficient manner. Because the components used as part of the completion/production systems disclosed herein may be of lower cost than those typically used in completion systems, depleted reservoirs that would not otherwise justify secondary recovery equipment may be efficiently produced. Additionally, the systems described herein may be used to provide control lines from the surface to multiple downhole components, thereby allowing operators to control the production of hydrocarbons from multiple production zones.

Further, embodiments disclosed herein may provide systems that allow for a single trip into the wellbore. Because the components of the presently disclosed system do not require feedthrough lines, due to the control lines that pass through the cup-type packers, the entire tool assembly may be disposed in the wellbore in a single trip. Single trip systems may also cost less to operate, reduce trips of the tool assembly, and result in more profitable wells.

While the invention has been described with respect to a limited number of embodiments, those skilled in the art, having benefit of this disclosure, will appreciate that other embodiments can be devised which do not depart from the scope of the invention as disclosed herein. Accordingly, the scope of the invention should be limited only by the attached claims.

What is claimed:

1. A completion system comprising:

a packer disposed in a wellbore; and a tubular string having a bore therethrough configured to land into the packer, the tubular string comprising:

an alignment sub;

a seal assembly disposed below the alignment sub and comprising:

at least two longitudinal bores disposed through the seal assembly and offset from the bore of the tubular string;

a sleeve sub disposed below the seal assembly, wherein the sleeve sub allows fluid communication between a bore of the tubular string and an annulus formed between the tubular string and the wellbore; and at least two control lines operatively connected to the sleeve sub, wherein the at least two control lines are run through the at least two longitudinal bores of the seal assembly.

2. The completion system of claim 1, wherein the seal assembly comprises a mechanical anchor and at least one sealing element.

3. The completion system of claim 1, wherein a first control line provides hydraulic pressure to a hydraulically actuated sleeve of the sleeve sub to move the hydraulically actuated sleeve into a first position and a second control line provides hydraulic pressure to the hydraulically actuated sleeve sub to move the hydraulically actuated sleeve into a second position.

4. The completion system of claim 1, further comprising a surface control unit operatively connected to the tubular string.

5. The completion system of claim 1, further comprising at least one sensor disposed on the tubular string.

6. The completion system of claim 2, wherein the seal assembly further comprises a shear release device.

7. The completion system of claim 1, wherein the alignment sub comprises a plurality of at least two longitudinal bores disposed through the seal assembly and offset from the bore of the tubular string, the at least two longitudinal bores configured to receive the at least two control lines.

8. The completion system of claim 3, wherein the tubing string is a production string and wherein the first position is an open position and the second position is a closed position.

9. The completion system of claim 1, wherein the tubing string is an injection string.

10. The completion system of claim 9, wherein the sleeve sub is configured to move between an open position, a closed position, and at least one partially open position.

11. The completion system of claim 1, wherein the packer is a cup-type packer comprising at least one control line bore and at least one control line disposed therethrough.

12. The completion system of claim 1, wherein the alignment sub includes a tubular body and a circumferential extension portion.

13. The completion system of claim 11, wherein the alignment sub further comprises at least two longitudinal bores disposed through the circumferential extension portion and offset from the bore of the tubular string.

14. A method of producing a well comprising:

setting at least one packer in a well;

perforating the well below the at least one packer;

running a tubular string into the well, the tubular string comprising:

an alignment sub;

a seal assembly disposed below the alignment sub and comprising:

at least two longitudinal bores disposed through the seal assembly and offset from the bore of the tubular string;

a sliding sleeve sub disposed below the seal assembly, wherein the sliding sleeve sub allows fluid communication between the bore of the tubular string and an annulus formed between the tubular string and the well; and at least two control lines operatively connected to the sliding sleeve sub, wherein the at least two control lines are run through the at least two longitudinal bores of the seal assembly;

engaging the seal assembly with the at least one packer;

operating the sliding sleeve sub to move the sleeve into an open position; and flowing a formation fluid from an annulus between the tubular string and a wall of the well into the tubular string.

15. The method of claim 14, wherein the sliding sleeve sub is hydraulically actuated.

16. The method of claim 14, further comprising setting a second packer in a well.

17. The method of claim 15, wherein the at least one packer comprises cup-type seals.

18. A method to inject a fluid into a wellbore, the method including:

setting at least one packer in a wellbore;

running a tubular string into the wellbore, the tubular string comprising:

an alignment sub;

a seal assembly disposed below the alignment sub and comprising:

at least two longitudinal bores disposed through the seal assembly and offset from the bore of the tubular string;

a sliding sleeve sub disposed below the seal assembly, wherein the sliding sleeve sub allows fluid communication between the bore of the tubular string and an annulus formed between the tubular string and the wellbore; and at least two control lines operatively connected to the sliding sleeve sub, wherein the at least two control lines are run through the at least two longitudinal bores of the seal assembly;

engaging the seal assembly with the at least one packer;

injecting a fluid from the tubular string into the wellbore.

19. The method of claim 18, further comprising:

modulating a flow rate of the fluid from the tubular string into the wellbore.

20. The method of claim 18, wherein the control lines extend longitudinally through at least a portion of the alignment sub.

* * * * *